US005318132A

United States Patent [19]

Odorisio

[11] Patent Number: 5,318,132

[45] Date of Patent: Jun. 7, 1994

[54] RETRIEVABLE WHIPSTOCK/PACKER ASSEMBLY AND METHOD OF USE

[75] Inventor: Vincent G. Odorisio, Midland, Tex.

[73] Assignee: Marathon Oil Company, Littleton, Colo.

[21] Appl. No.: 967,648

[22] Filed: Oct. 28, 1992

[51] Int. Cl.[5] ..... E21B 23/00

[52] U.S. Cl. ..... 166/382; 166/387; 166/117.6; 166/123; 166/181

[58] Field of Search ..... 166/117.5, 117.6, 123, 166/134, 382, 386, 387, 181

[56] References Cited

U.S. PATENT DOCUMENTS

| | | | |
|---|---|---|---|
| 4,397,355 | 8/1983 | McLamore | 166/117.6 X |
| 4,530,398 | 7/1985 | Greenlee et al. | 166/123 |
| 4,565,247 | 1/1986 | Tapp et al. | 166/181 X |
| 4,665,977 | 5/1987 | Mullins | 166/134 |
| 5,113,938 | 5/1992 | Clayton | 166/117.6 |
| 5,154,231 | 10/1992 | Bailey et al. | 166/117.6 X |
| 5,197,547 | 3/1993 | Morgan | 166/181 X |

*Primary Examiner*—Ramon S. Britts
*Assistant Examiner*—Roger J. Schoeppel

[57] ABSTRACT

Whipstock/packer assembly equipment and procedures to retrieve and reuse a whipstock assembly during drilling operations for horizontal drainhole application. The anchor is seated in a retrievable packer and has a bore communication with the fluid path in the whipstock and ports through the anchor body to the bore. Fluid pumped through the ports after a drilling operation flush cuttings from the annulus between the anchor and the associated packer and carry them to the surface, thereby preventing the cuttings from hampering removal of the anchor. The same fluid path can be used to introduce a gel to the annulus prior to drilling to prevent cuttings from collecting on the packer. Introduction of fluid after the drilling operation may be employed to remove the gel and collected cuttings or the whipstock/packer assembly may be withdrawn without flushing.

15 Claims, 3 Drawing Sheets

RETRIEVABLE WHIPSTOCK/PACKER ASSEMBLY AND METHOD OF USE

FIELD OF THE INVENTION

This invention relates to the drilling of horizontal drainholes in a well. More particularly, it relates to a whipstock and packer-anchor assembly and a method of use which permits retrieval of a whipstock/packer assembly employed in a drilling operation.

BACKGROUND OF THE INVENTION

One of the operations which is required when drilling a horizontal drainhole is the sidetracking process wherein drilling from an existing cased wellbore into the adjacent formation is initiated. Currently, there are several different ways that this can be done, none of which is entirely satisfactory.

One method to initiate sidetracking is to fill the casing with cement to the desired depth, which will force the drilling equipment into the formation. This is possible if the cement has a higher compressive strength than that of the formation. This method is unsatisfactory, however, since the cement plug does not always have a compressive strength greater than the formation and accurate control of the hole direction is difficult.

Another method is to run a whipstock into the cased wellbore on an inflatable packer to the desired depth, after which an orientation survey is run, the whipstock face is turned in the desired direction and the packer is inflated. While this method can properly orient the whipstock initially, it is difficult to maintain the desired direction because the packer tends to turn as it is inflated, causing the whipstock face to turn with it. In addition, the packer is subjected to torque forces caused by the drilling operation. If the torque is severe enough the friction between the inflated element and the casing is overcome, causing the assembly to turn or drop down the casing. There is also the possibility that the packing element could deflate and drop down the casing.

A third method is to set a permanent seal bore packer with a keyed sub at the desired depth in the casing, run an orientation survey to determine the orientation of the key and set the angle between the key slot of the whipstock anchor and the whipstock face. The whipstock anchor is then run into the packer and latched in place, which ensures that the whipstock face is set in the desired direction. Although the equipment used in this method is designed to enable the whipstock and anchor to be withdrawn while leaving the packer in place, it has been found that as the formation is being drilled, cuttings tend to settle out on top of the packer and in the annulus between the whipstock and casing, which interferes with the removal of the whipstock assembly and makes the entire system permanent. Since a whipstock-/packer assembly is costly, the ability to retrieve and reuse not only the whipstock assembly but the packer as well would greatly reduce expenses for the drilling of a horizontal drainhole.

It is therefore an object of the invention to provide a whipstock/packer assembly which is capable of being precisely positioned in the intended direction of the drainhole to be drilled and which can readily be retrieved from a well after the hole is drilled.

BRIEF SUMMARY OF THE INVENTION

The invention employs a whipstock and packer-anchor assembly having a generally cylindrical body adapted to be seated in an associated retrievable packer. The packer-anchor includes a seal for sealing the space between the anchor and the bore of the packer and gripping means located above the seal for preventing relative movement between the anchor and the packer. A whipstock having a fluid passageway extending therethrough is attached to the upper end of the packer-anchor so that the fluid passageway of the whipstock is in fluid communication with a fluid passageway in the anchor. The anchor includes one or more ports which are located above the seal and are in fluid communication with the fluid passageway of the anchor, whereby fluid can be pumped through the fluid passageways in the whipstock and the anchor body, out the ports and up the annulus between the anchor body and an associated packer.

This arrangement permits two different approaches to be taken in the removal of cuttings. Fluid may be pumped through the fluid passageways in the whipstock and the packer-anchor, out the port, up the annulus between the anchor and the packer bore, and then up the annulus between the whipstock and the casing to remove cuttings which accumulate there from the drilling operation. By flushing the cuttings from these areas the problem of the cuttings collecting and causing the assembly to stick in the well when attempting to retrieve it is solved. Another use of the ports is to pump a gel solution into the annulus between the anchor and the packer bore and up over the packer and whipstock so as to produce a gel-filled area that covers the packer and anchor to prevent cuttings from collecting there. The gel is subsequently broken away by the retrieval operation or is flushed from the area after the drilling operation by fluid pumped through the fluid passageways, removing both the gel and the cuttings.

Other features of the assembly and method are described in the detailed description of the preferred embodiments, wherein the above and other aspects of the invention, as well as other benefits, will readily become apparent.

DETAILED DESCRIPTION OF THE PREFERRED EMBODIMENTS

Figure 1:
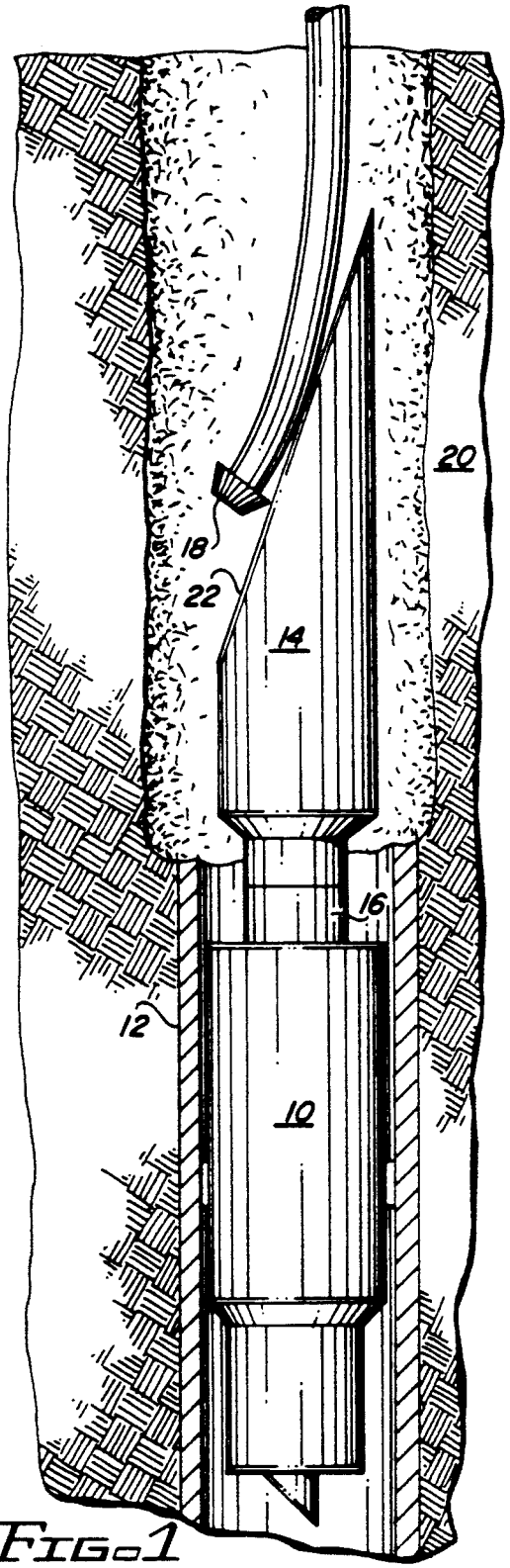
FIG. 1 is a simplified partial longitudinal sectional view of a well in which the whipstock anchor of the invention is located.

Referring to FIG. 1, a horizontal drainhole drilling operation in a cased well is typically carried out by the illustrated assembly. After a section of casing 12 has been removed by milling, a retrievable seal bore packer 10 is set in the casing 12 and a whipstock 14 is attached to an anchor 16 and set in the packer 10. In operation, the packer and whipstock are set at the desired height to determine the depth and direction of the sidetrack and a drilling assembly 18 is activated. The drilling assembly follows the contour of the beveled face 22 of the whipstock, which directs the tool into the formation 20. In accordance with the invention, the packer-anchor 16 is of special construction to prevent cuttings from the drilling operation which tend to settle out in the annulus between the whipstock and the casing from preventing retrieval of the whipstock and anchor assembly.

Figure 2:
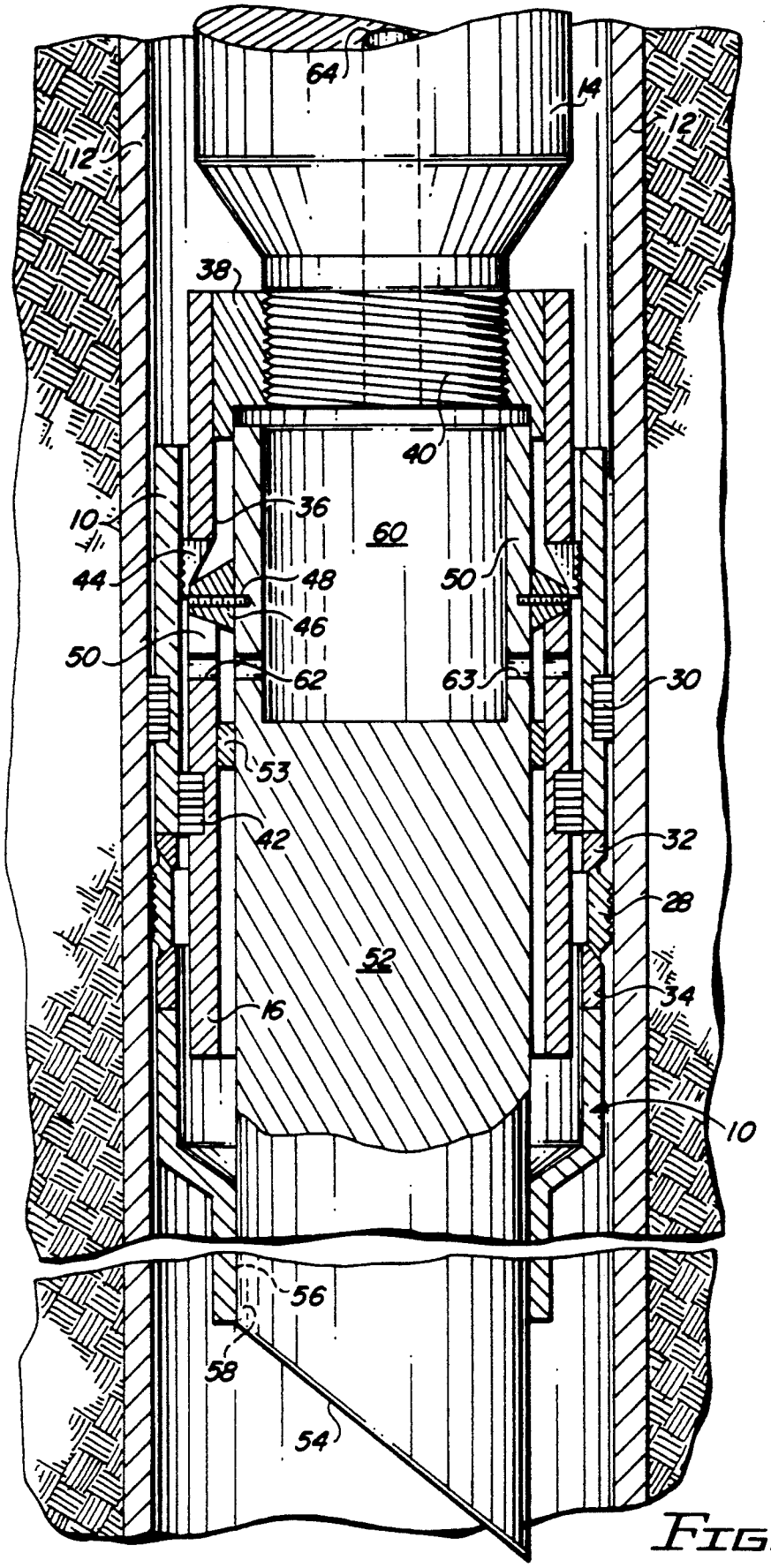
FIG. 2 is an enlarged simplified partial longitudinal sectional view of a well, showing the relationship of the whipstock anchor to other associated elements in a whipstock installation.

The anchor is shown in more detail in FIG. 2, which illustrates the relationship of the various elements employed in a horizontal or directional drilling operation. The packer 10 is a retrievable seal bore packer including slips 28 for gripping the face of the casing 12 to hold the packer in place and a seal 30 for sealing the annulus between the packer and the casing. The slips 28 may be of any standard design, shown for the sake of illustration as being actuated by upper and lower conical elements 32 and 34. The seal 30 is also of any suitable design, such as one formed by a stack of packing elements.

Figure 4:
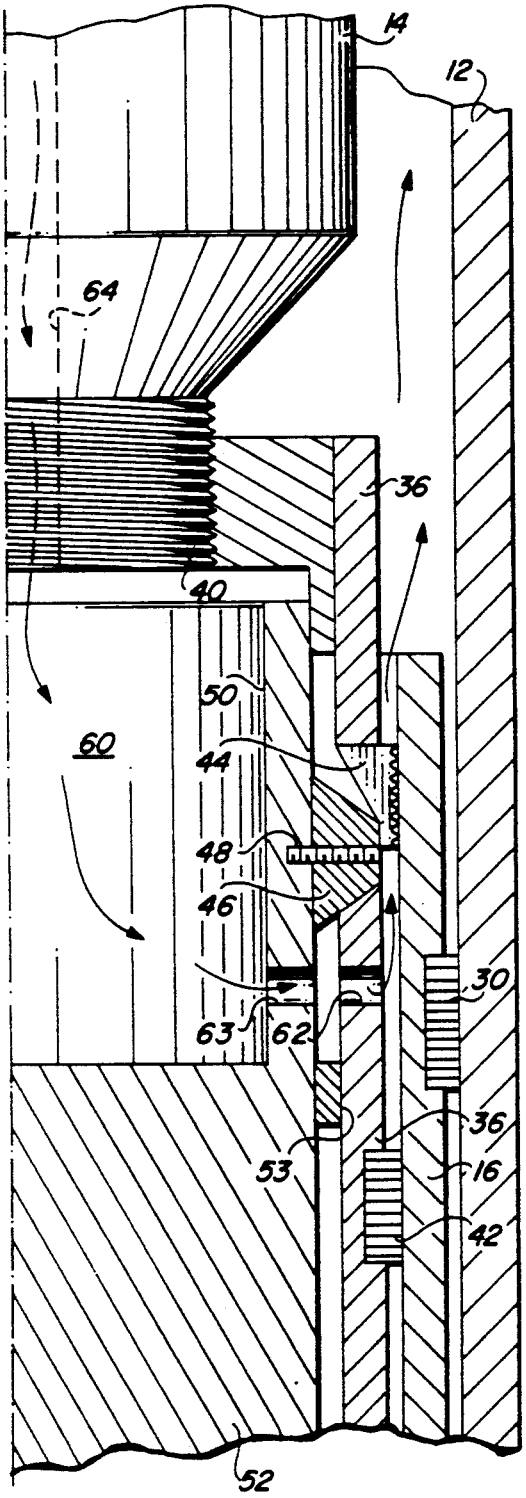
FIG. 4 is an enlarged partial longitudinal sectional view of the upper portion of the whipstock anchor, showing the fluid flow path of a flushing operation more clearly.

The anchor 16 includes a body portion 36 having a threaded upper end socket 38 to which the lower threaded end 40 of the whipstock 14 is connected. A seal 42, which may be of any suitable construction, such as one similar to the packer seal 30, is provided at a lower portion of the anchor body and slips 44 are provided above the seal. The slips 44, which are more clearly shown in FIG. 4, may be of standard design, being held in operable condition by engagement of the slip ring 46 against the tapered back face of the slip plates. As is common, the slip ring is held in place by shear pins 48 attached to sleeve 50, which is spaced from the anchor 16, so that upon being subjected to a shear force exceeding the shear strength of the pins, the pins will fail and the ring 46 will drop out of engagement with the slips 44. In this manner the anchor can be detached from the packer and be free to be pulled out of the well.

The anchor also includes an anchor stinger 52 which extends for a distance below the sleeve 50, with the space between the anchor stinger and the anchor 16 being sealed by seal 53. The lower end of the stinger is sloped to form a mule shoe 54 which acts to guide the stinger into the sub 26 of the packer.

The structure described thus far is illustrative of conventional retrievable packer and anchor constructions. However, in order to permit the assembly to be used in a drilling operation requiring orientation of a whipstock face, the stinger 52 is also provided with a key slot 56 for receiving a key 58 on the lower portion of the packer. In addition, in order to prevent the various internal components of the packer from rotating during a drilling operation, the components are pinned together. Although the details of this pinned arrangement are not shown, those skilled in the art will readily understand how it is done. A suitable retrievable packer that can be modified in this manner is the Model SC-2P packer of Baker Oil Tools.

The initial manner of preparing for a horizontal drilling operation is also conventional. In accordance with common practices, the packer is run in the cased well and set at the desired depth by actuating the slips 28. An orientation survey is then run by means well known in the art to determine the orientation of the key 58. The angle between the key slot 56 of the anchor stinger and the whipstock face 22 is then set to give the desired direction of drilling, and the anchor and whipstock assembly is run into the well on tubing. The packer-anchor is then latched into the packer bore to place the equipment in the position shown in FIG. 2. The key and key slot line up to position the whipstock face in the desired direction.

Still referring to FIG. 2, in accordance with the invention the anchor body 36 has been provided with a fluid passageway 60 from the threaded socket 38 to the anchor stinger 52. The passageway, which is illustrated in the drawing in the form of a chamber, may be provided by designing the anchor components accordingly or by drilling a bore through conventional anchor components. The anchor body is also provided with ports 62 and the sleeve 50 with ports 63, as by drilling, to provide fluid communication with the passageway 60. In addition, the whipstock has a central bore 64 extending through threaded end 40 to provide fluid communication with the passageway 60.

As stated above, when a whipstock drilling operation is carried out, cuttings tend to fall into the annulus between the whipstock and the casing, settling out on top of the packer. The cuttings can prevent the retraction of slips of the anchor and act as a barrier to upward movement of the assembly, making it extremely difficult, if not impossible, to retrieve the whipstock anchor assembly. In accordance with the invention, the fluid passageway in the anchor can be utilized to remove the cuttings to thereby allow the assembly to be freely pulled up out of the casing.

Figure 3:
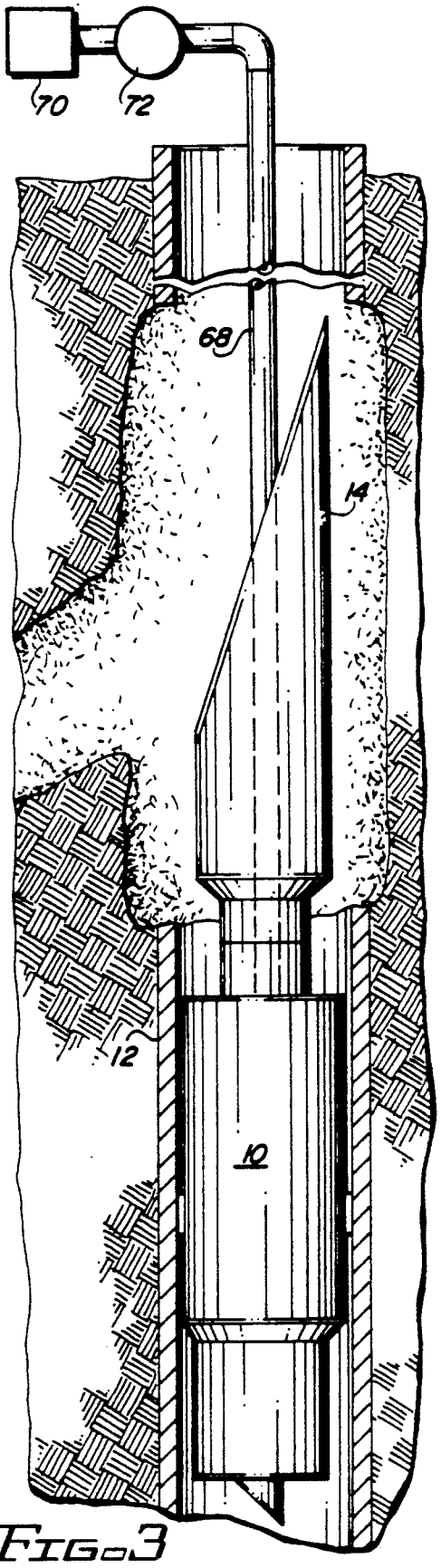
FIG. 3 is a view similar to that of FIG. 1, but showing tubing in place through which fluid flows to the whipstock anchor assembly.

As illustrated in FIG. 3, after drilling a horizontal wellbore tubing 68 is connected to the whipstock by any convenient means. Fluid is then pumped from a source 70 on the surface by pump 72 down the tubing 68 and into the whipstock. As seen more clearly from the flow arrows in FIG. 4, the fluid continues from the whipstock bore 64 into the anchor bore or chamber 60 and out through the circulating ports 62. Because the seal 42 blocks the annulus between the anchor body 36 and the packer 16 to prevent further downward movement of the fluid, flow continues up the annulus past the slips 44. Continued fluid movement up the annulus between the whipstock 14 and the casing 12 and up to the surface carries with it cuttings which may have been deposited in the flow area during the drilling operation. By clearing out the space through which the assembly must move during retrieval, removal of the whipstock and anchor assembly by standard procedures is made possible. After retrieval of the assembly, the retrievable packer can then be removed in a separate operation, again by standard procedures.

In another aspect of the invention, steps may be taken prior to the cutting operation to facilitate removal of the whipstock and anchor assembly. To carry out this procedure the tubing 68 is connected to the whipstock as explained above. Instead of pumping a flushing fluid down the tubing, a suitable gel solution is pumped. While the invention is not limited to any particular gel, it should be capable of maturing, as by crosslinking or other activation, over a relatively short period of time, such as from 2 to 72 hours, into a film body capable of supporting the weight of the cuttings. An example of such a gel is an acrylamide polymer crosslinked with a crosslinking agent comprising a chromic carboxylate complex. The formulation and preparation of a suitable gel is well within the skill of those in the gel art and may be readily obtained through suppliers of the gel ingredients.

Figure 5:
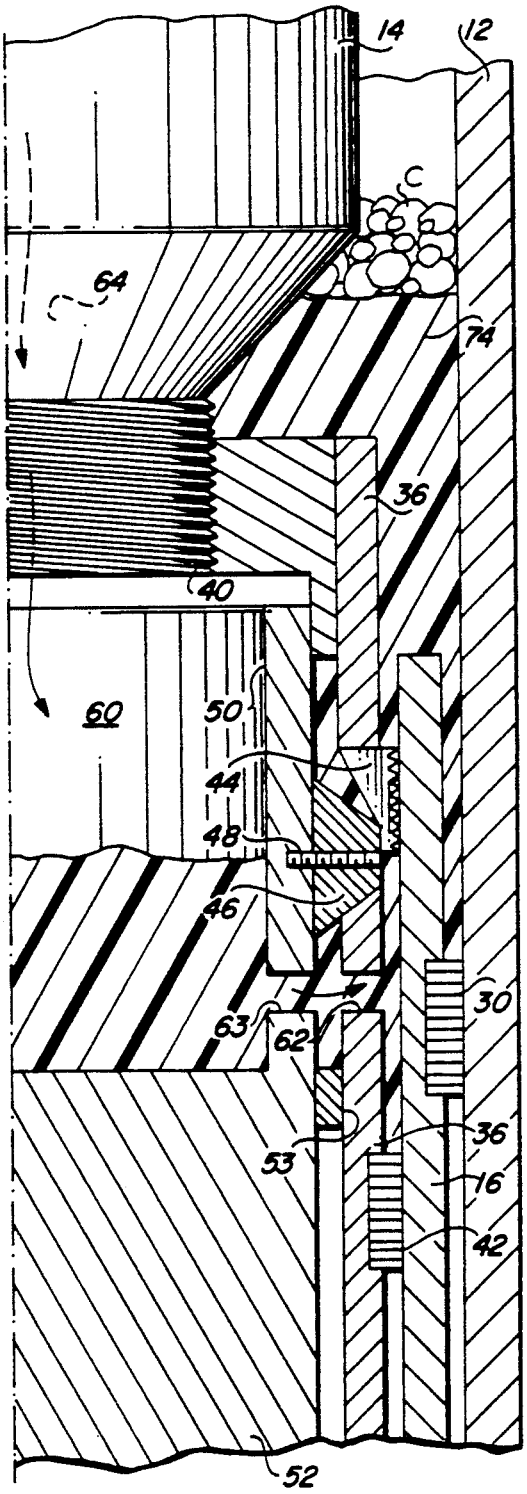
FIG. 5 is an enlarged partial longitudinal sectional view similar to that of FIG. 4, but showing the assembly being used to move a gel solution into place.

A sufficient quantity of gel solution is pumped through the same flow path described above to cover the anchor and packer while stopping short of the drilling area, after which further flow is ceased. The well is maintained in static condition while the solution is allowed to mature. After the gel solution has matured into a firm gel, the drilling operation can be carried out. Because the cuttings C are deposited on top of the firm gel 74, as illustrated in FIG. 5, they are prevented from collecting around the anchor slips, in the annulus between the anchor and the packer and in the annulus between the whipstock and the casing. Thus, the cuttings do not become wedged into these spaces to prevent withdrawal of the whipstock and anchor assembly or the packer. The gel itself does not prevent removal of the equipment inasmuch as it is not capable of providing any significant resistance to upward movement of the equipment.

If desired, the fluid flushing activity described above may also be carried out after the drilling operation with the gel still in place. In such a case the fluid pressure readily dislodges the gel and carries it up to the surface, along with the cuttings which had been lying on top of the gel.

It should now be appreciated that the invention prevents cuttings from drilling operations from obstructing removal of a whipstock anchor assembly or the packer in which the assembly had been seated by an inexpensive flushing or gelling procedure or both. Implementation of these procedures is made possible by the fluid path provided in the whipstock anchor which enables flushing fluid or a gel solution to be introduced into the casing. The fluid path is effectively provided by boring holes in a commercially available whipstock anchor as described above. Not only is the necessary equipment and method economical, the savings resulting from being able to retrieve and reuse the assemblies is quite significant.

It will be understood that changes to the apparatus and method of the invention which do not affect the overall basic function and concept thereof may be made without departing from the spirit and scope of the invention, as defined in the appended claims.

What is claimed is:

1. A packer-anchor for supporting a whipstock in a horizontal well drilling operation, comprising:

a generally cylindrical body adapted to be seated in an associated retrievable seal bore packer, the body having an upper end adapted to be connected to a whipstock;

a circumferential seal on the body adapted to provide a seal between the anchor body and the bore of an associated packer;

gripping means located between the circumferential seal and the upper end of the body for preventing relative movement between the anchor body and an associated packer;

an upper portion of the anchor body having a fluid passageway therethrough;

means for sealing off the fluid passageway at a point below the gripping means; and at least one port in the upper portion of the anchor body located above the circumferential seal, the port providing fluid communication with the fluid passageway, whereby fluid can be pumped through the fluid passageway, out the port and up an annulus between the anchor body and an associated packer.

2. A packer-anchor as defined in claim 1, wherein the upper portion of the anchor body includes a plurality of ports located between the sealing means and the gripping means.

3. A whipstock assembly for use in a horizontal well drilling operation, comprising:

an anchor having a generally cylindrical body adapted to be seated in an associated retrievable seal bore packer;

a whipstock connected to the upper end of the anchor;

a circumferential seal on the anchor body adapted to provide a seal between the body and the bore of an associated packer;

gripping means located between the circumferential seal and the upper end of the anchor body for preventing relative movement between the body and an associated packer;

the whipstock having a fluid passageway extending therethrough;

an upper portion of the anchor body having a fluid passageway connected with the whipstock fluid passageway;

means for sealing off the fluid passageway of the anchor body at a point below the gripping means; and at least one port in the upper portion of the anchor body located above the circumferential seal, the port providing fluid communication with the fluid passageway, whereby fluid can be pumped through the fluid passageways in the whipstock and the anchor body, out the port and up an annulus between the anchor body and an associated packer.

4. A whipstock and packer assembly for use in a horizontal well drilling operation, comprising:

a retrievable packer having a bore and gripping means for gripping the casing of a well;

an anchor seated in the bore of the packer, the anchor having a body portion spaced from the packer bore so that there is an annulus therebetween;

a whipstock connected to the upper end of the anchor;

a circumferential seal on the anchor body engaging the bore of the packer and forming the bottom of the annulus;

gripping means on the anchor body located between the circumferential seal and the upper end of the anchor engaging the bore of the packer for preventing relative movement between the anchor and the packer;

the whipstock having a fluid passageway extending therethrough;

an upper portion of the anchor body having a fluid passageway connected with the whipstock fluid passageway;

means for sealing off the fluid passageway of the anchor body at a point below the gripping means of the anchor; and at least one port in the upper portion of the anchor body located above the circumferential seal, the port providing fluid communication with the fluid passageway, whereby fluid can be pumped through the fluid passageways in the whipstock and the anchor, out the port and up the annulus between the anchor and the packer bore.

5. A whipstock anchor as defined in claim 4, wherein the means for sealing off the fluid passageway comprises an anchor stinger within the anchor body.

6. A whipstock anchor as defined in claim 5, wherein the anchor stinger includes a key slot and the packer includes a key engaging the key slot, the key and key slot enabling the whipstock to be oriented in a desired direction.

7. A whipstock anchor as defined in claim 4, wherein components in the retrievable packer are prevented from rotating during a drilling operation.

8. A whipstock anchor as defined in claim 4, wherein the upper portion of the anchor body includes a plurality of ports located between the circumferential seal and the gripping means.

9. A method for facilitating retrieval of a whipstock and anchor assembly from a cased well, comprising:

seating a retrievable packer having a bore in the well casing;

attaching a whipstock having a fluid passageway extending therethrough to the upper end of an anchor having a fluid passageway connecting with the whipstock fluid passageway;

seating the anchor in the packer bore so that there is an annulus therebetween, the anchor including:

a circumferential seal engaging the bore of the packer and forming the bottom of the annulus, gripping means above the circumferential seal engaging the bore of the packer to prevent relative movement between the anchor and the packer, means for sealing off the fluid passageway of the anchor body at a point below the gripping means of the anchor, and at least one port in the anchor above the circumferential seal communicating with the fluid passageway of the anchor;

carrying out a horizontal drilling operation; and pumping fluid through the fluid passageways in the whipstock and the anchor, out the port and up the annulus between the anchor and the packer bore to remove cuttings from the drilling operation.

10. A method for facilitating retrieval of a whipstock and anchor assembly from a cased well as defined in claim 9, including the steps of introducing a gel solution capable of maturing to a firm gel into the fluid passageways of the whipstock and anchor prior to the drilling operation, the gel solution flowing out the port and up the annulus between the anchor and packer bore to cover the upper face of the packer, and waiting for the gel solution to mature to a firm gel before drilling to prevent cuttings from the drilling operation from falling into the annulus and on top of the packer, the gel being capable of being removed by the fluid pumped through the passageways after the drilling operation.

11. A method for facilitating retrieval of a whipstock and anchor assembly from a cased well, comprising:

seating a retrievable packer having a bore in the well casing;

attaching a whipstock having a fluid passageway extending therethrough to the upper end of an anchor having a fluid passageway connecting with the whipstock fluid passageway;

seating the anchor in the packet bore so that there is an annulus therebetween, the anchor including:

a circumferential seal engaging the bore of the packer and forming the bottom of the annulus, gripping means above the circumferential seal engaging the bore of the packer to prevent relative movement between the anchor and the packer, means for sealing off the fluid passageway of the anchor body at a point below the gripping means of the anchor, and at least one port in the anchor above the circumferential seal communicating with the fluid passageway of the anchor;

introducing a gel solution capable of maturing to a firm condition into the fluid passageways of the whipstock and anchor prior to a drilling operation utilizing the whipstock, the gel solution flowing out the port and up the annulus between the anchor and packer bore to the upper face of the packer; and waiting for the gel to mature to a firm condition before beginning a drilling operation to prevent cuttings from falling into the annulus and on top of the packer.

12. A method for facilitating retrieval of a whipstock and anchor assembly from a cased well as defined in claim 11, wherein the gel comprises an acrylamide polymer crosslinked with a crosslinking agent comprising a chromic carboxylate complex.

13. A method for facilitating retrieval of a whipstock and anchor assembly from a cased well as defined in claim 11, wherein the assembly is pulled from the well, the pulling force being sufficient to overcome any resistance by the gel to upward movement of the assembly.

14. A method for facilitating retrieval of a whipstock and anchor assembly from a well casing as defined in claim 11, including the step of pumping fluid through the fluid passageways in the whipstock and the anchor after a drilling operation, the fluid being capable of removing gel encountered in its flow path out the port and up the annulus between the anchor and the packer bore, whereby the gel and cuttings from the drilling operation resting on the gel are removed.

15. All inventions substantially as shown and described herein.

* * * * *